United States Patent [19]

Schulte et al.

[11] 3,981,778

[45] Sept. 21, 1976

[54] COKE OVEN HOOD APPARATUS

[75] Inventors: Fritz Schulte, Meerbusch-Buderich; Johann G. Riecker, Ratingen; Martin Bender, Dusseldorf-Eller, all of Germany

[73] Assignee: Hartung, Kuhn & Co. Maschinenfabrik GmbH, Dusseldorf, Germany

[22] Filed: Apr. 8, 1975

[21] Appl. No.: 566,428

[30] Foreign Application Priority Data

Apr. 16, 1974 Germany ..... 2418323

[52] U.S. Cl. ..... 202/263; 105/146; 105/147

[51] Int. Cl.[2] ..... C10B 27/00

[58] Field of Search ..... 202/227, 262, 263; 214/87 R; 212/15, 18, 125, 4; 105/146, 147

[56] References Cited

UNITED STATES PATENTS

| | | | |
|---|---|---|---|
| 1,801,558 | 4/1931 | Keen | 105/147 |
| 2,873,862 | 2/1959 | Cone | 212/4 |
| 3,606,839 | 9/1971 | Stafford et al. | 105/147 X |
| 3,746,626 | 7/1973 | Morrison, Jr. | 202/227 X |
| 3,801,472 | 4/1974 | Kemmetmueller | 202/263 |
| 3,801,473 | 4/1974 | Schoen et al. | 202/227 X |
| 3,809,622 | 5/1974 | Knappstein et al. | 202/227 X |
| 3,844,900 | 10/1974 | Schulte | 202/227 |

*Primary Examiner*—Morris O. Wolk
*Assistant Examiner*—Arnold Turk
*Attorney, Agent, or Firm*—Michael J. Striker

[57] ABSTRACT

Apparatus for use with a coke oven having a carriageway for a quenching car along a side thereof, which apparatus comprises a hood for covering a quenching car on the carriageway, and a supporting structure which supports the hood solely from that side of the carriageway which is remote from the coke oven.

9 Claims, 2 Drawing Figures

COKE OVEN HOOD APPARATUS

This invention relates to a coke oven and, more particularly, is concerned with apparatus for preventing the emission of gases and dust into the atmosphere, especially when a cake of coke is ejected from the coke oven and when the cake of coke comes into contact with a quenching car and, in some cases, also during transport of the mass of red-hot coke in the quenching car to a quenching tower.

Such an apparatus comprises a hood and a supporting structure for the hood. The hood is supported so that it covers the quenching car which travels on a carriageway, usually a railway, extending along a side of the coke oven and which takes the cake of coke from the oven chambers off a cake guide designed to travel up to the oven chamber to be emptied and carries it away, the hood with its supporting structure being supported in such a way that it can travel along the side of the coke oven.

Problems are involved in satisfactorily supporting the hood. Supporting the hood on the cake guide car itself is unfavourable because in this case, the cake guide car has to absorb a considerable tilting moment under the weight of the hood overhanging on one side and its supporting structure, which can have an adverse effect upon the satisfactory operation of the cake guide. On the other hand, the space available for accommodating a separate hood supporting structure which does not interfere with the manoeuvrability and travel of the two servicing machines travelling independently of one another on the same side of the oven, namely the quenching car and the cake guide car, is limited by the space occupied by these servicing machines.

An object of the present invention is to provide apparatus comprising a covering hood for the quenching car, and a supporting structure for the hood, which apparatus is able to travel together with one or both of the cake guide and quenching car without interfering with their manoeuvrability.

According to the present invention there is provided in association with a coke oven having a carriageway for a quenching car along a side thereof, an apparatus which comprises a hood for covering a quenching car on the carriageway, and a supporting structure which supports the hood solely from that side of the carriageway which is remote from the coke oven.

In one embodiment of the invention the hood is supported from the supporting structure by means of a supporting frame, the arrangement being such that the supporting frame can travel along the supporting structure. The supporting frame may, for example, co-operate with rails provided on the supporting structure by means of rollers provided on the supporting frame.

The carriageway for the quenching car may be, for example, a railway track.

The supporting structure for the hood can be positioned where enough space is available to accommodate it despite the presence of the cake guide car and the quenching car co-operating therewith. The fact that the hood is supported independently of the quenching car and the cake guide car enables it to be designed and manoeuvred as required without any need for special measures for taking into account the construction and supporting of the hood. In addition, the hood can be moved independently of the other two servicing machines, so that the hood is able to travel either together with the cake guide car and the quenching car or with one of them or even independently of them.

By virtue of the invention, the travel gear of the hood is largely insulated from the heat effect of the coke oven, especially when the oven chambers are emptied, so that the hood can be provided with robust, substantially maintenance-free running gear.

The overhanging support of the hood according to the invention is preferably obtained by means of two rails extending laterally of one another along the supporting structure, of which the inner rail, situated nearer the coke oven, is directed upwards and, as a result, supports the hood supporting structure from below through corresponding rollers, whilst the outer rail, advantageously situated at a higher level than the inner rail, is directed downwards and supports the hood-supporting frame from above.

In one preferred embodiment of the invention, a counterweight projecting outwards beyond the rails of the supporting structure is arranged on the outside of the hood-supporting frame in order to relieve the overhanging part thereof. The counterweight may extend for example above the outer rail and the supporting structure. A third rail may also be provided on the upper side of the supporting structure, co-operating with correspondingly shaped guide rollers on the hood-supporting frame, in particular for laterally guiding the hood structure.

The hood according to the invention is with advantage provided with its own motor so that it is able to travel independently of the quenching car and the cake guide car. In the preferred embodiment, several individual drives synchronised with one another are flanged onto rollers which run along the rail of the supporting structure situated nearer the coke oven. Preferred individual drives are small electric motors which act on the rollers through gear systems. However, it is also possible to use hydraulic or pneumatic drives, for example.

Instead of equipping the hood with its own motor, it can also be of advantage to design the hood to travel freely, in which case it may be entrained in particular by the cake guide car or even either by the cake guide car or by the quenching car. The drive elements provided for this purpose, which are preferably arranged on the hood structure, are advantageously adjustable, so that they may be brought into engagement with or disengaged from that of the two servicing machines by which the hood is to be entrained. Adjustments which provide for remote control may be provided for this purpose.

The hood structure is preferably also provided with a brake in order to enable it to be slowed down or stopped independently of the other two servicing machines. For example, a motor for the hood structure may be designed to act as a brake when necessary.

In cases where the hood is connected through structural components for drive purposes or for other reasons, the connection is preferably temporary, so that the hood and cake guide car can also travel independently of one another.

In addition to servicing units for the hood, other servicing units for the coke oven or for the cake guide car may additionally be arranged on the hood-supporting frame, being used during emptying of an oven chamber. Attachments may also be arranged on the supporting structure as well, for example a gas collecting pipe which extends along the coke oven and into which the exhaust gas removed from the hood may be introduced, for example by means of a gas-transfer gate travelling with the hood.

A particularly space-saving support for the hood and its supporting frame is obtained when the supporting structure comprises an upwardly directed lower rail, along which run rollers of the hood structure, and an upper lateral rail arranged at an interval above the lower rail on which a horizontal supporting wheel of the hood structure acts on that side remote from the coke oven.

For a better understanding of the present invention and to show more clearly how the same may be carried into effect reference will now be made, by way of example, to the accompanying drawings in which.

Figure 1:
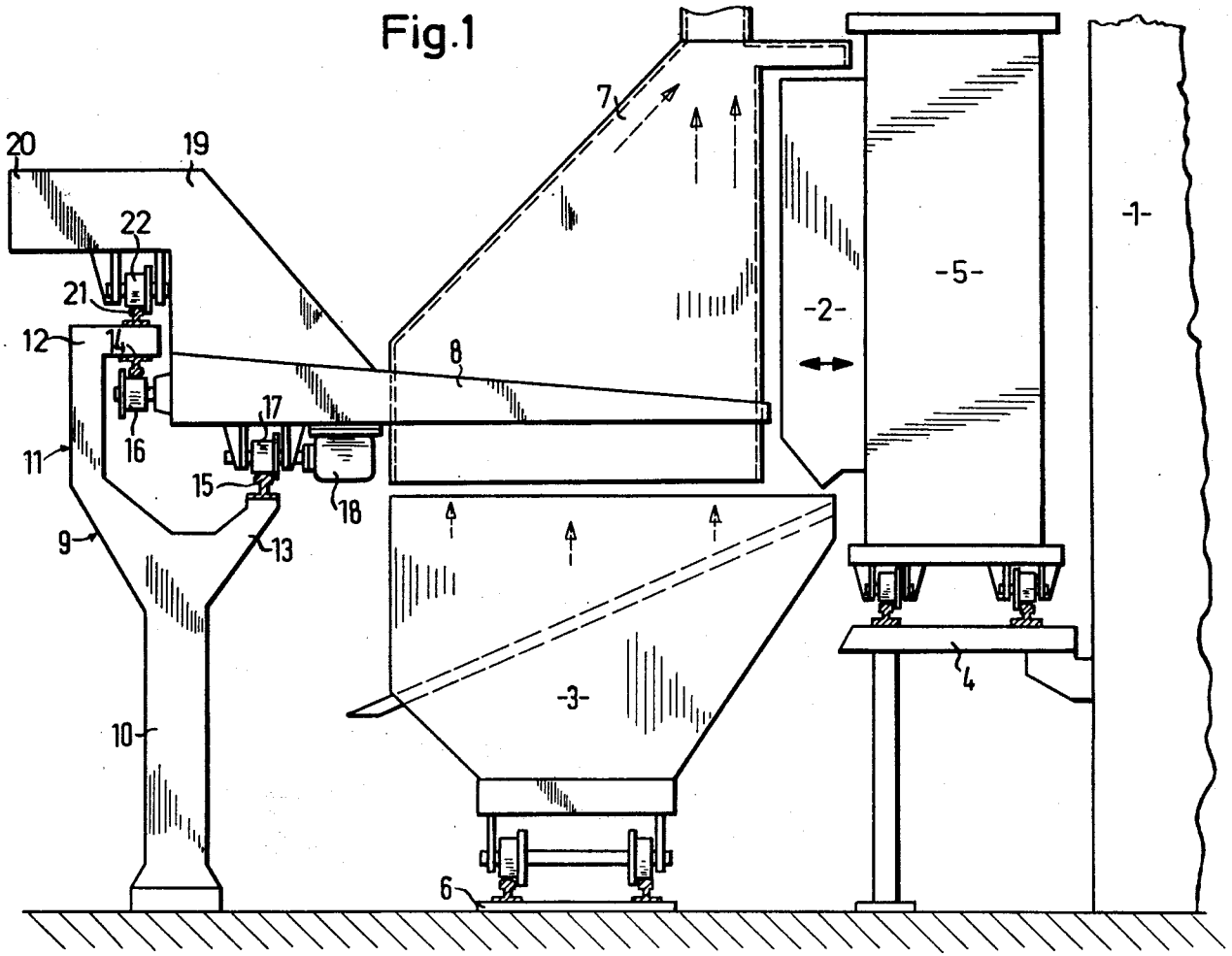
FIG. 1 shows one embodiment of the present invention.

The drawings show a side wall of a coke oven 1 at which the red-hot cake of coke is ejected from one of a number of successive coke oven chambers through a cake guide, or coke guide, 2 into a waiting quenching car 3. The cake guide 2 is arranged on a cake guide car, or coke guide car, 5 which is designed to travel by way of rollers and rails along the coke oven 1 on a master walk, or gas gallery, 4. The quenching car 3 arranged adjacent the cake guide car 5 is designed to travel with its running gear on a quenching car track 6 under the drive of a locomotive (not shown) along the coke oven 1 up to a quenching tower. Above the quenching car 3 there is a hood 7 which is open towards and at least partly covers the quenching car 3 and by means of which any dust and gases formed can be removed under suction, and either be deposited or cleaned. Through its supporting frame 8, the hood 7 is supported solely by a supporting structure 9 on that side of the quenching car track 6 remote from the coke oven.

As shown in FIG. 1, the supporting structure 9 consists of a pillar 10 extending along the coke oven 1, optionally with interruptions, or of several pillars arranged at intervals one behind the other and of a head in the form of a shell 11 with a substantially C-shaped cross-section. The shell 11 is open towards the coke oven. The upper side 12 of the C extends substantially horizontally above and laterally of the lower side 13 of the C. The upper side 12 of the C is situated at a greater distance from the coke oven 1 than the end of the lower side 13 of the C. An outer rail 14 is suspended from the underneath of the upper side 12 of the C, whilst an inner rail 15 is arranged on the top of the lower side 13 of the C. The supporting frame 8 of the hood 7 is mounted to travel along the rails 14 and 15 by means of correspondingly arranged outer rollers 16 on the outside of the supporting frame 8 and inner rollers 17 on the underneath of the supporting frame 8. Rims cooperating with the corresponding side of the rails 14 and 15 are formed on the outside of the outer rollers 16 and on the inside of the inner rollers 17. A motor 18 is preferably flanged onto each of several inner rollers 17 with a reduction gear in between. In cases where electric motors are used for the motors 18, an associated current rail or, better still, a trailing cable, which may be laid along the base of the shell 11, may be used for supplying current.

A counterweight 20 is arranged on an arm 19 of the supporting frame 8 which extends upwards beyond the upper side 12 of the C, extending towards the outside of the supporting structure 9 beyond the rails 14 and 15. Another rail 21, along which run additional rollers 22, is provided on the top of the upper side 12 of the C immediately above the outer rail 14. The additional rollers 22 secured to the underneath of that part of the arm 19 leading to the counterweight may be used, in conjunction with the rail 21, to improve the lateral guiding of the hood structure 7 and 8 or may even take over additional supporting functions.

Instead of being provided with its own motor 18, the hood structure 7 and 8 may also be designed to travel freely along the supporting structure 9. To this end, drive elements (not shown) may be provided, preferably on the hood structure 7 and 8, being adjustable in engagement with the cake guide car 5. These or additional drive elements may even be designed and arranged in such a way that they may be brought optionally or alternately into engagement with the quenching car 3, so that, in this case, the hood structure 7 and 8 is entrained by the quenching car itself.

It can readily be seen from the drawing that the overhanging support of the hood structure 7 and 8 on a supporting structure 9 on that side of the quenching car tracks 6 remote from the coke oven 1 provides for the safe, reliable travel and support of the hood structure 7 and 8 without in any way interfering with the manoeuvrability and travel of the quenching car 3 and cake guide car 5. The running gear for the hood structure 7 and 8 lying on that side of the quenching car 3 remote from the coke oven 1 is accommodated there relatively safe from attack by corrosive gases or high temperatures.

Figure 2:
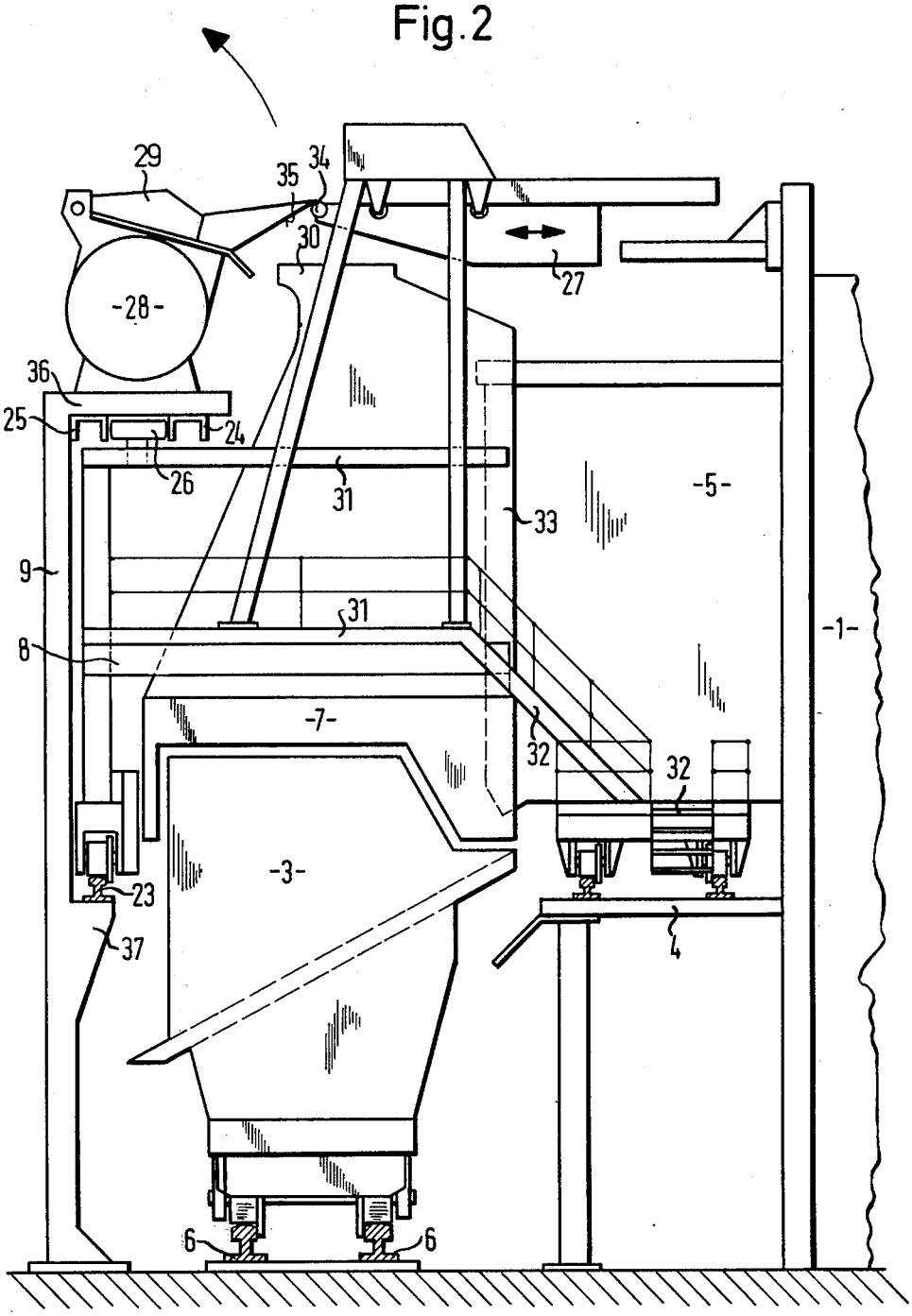
FIG. 2 shows a second embodiment of the present invention.

As shown in FIG. 2, the supporting structure 9 is provided on that side facing the coke oven 1 with a supporting shoulder 37, the top of which is fitted with a lower rail 23 which takes up the weight of the entire hood structure 7 and 8. A supporting arm 36 extending towards the coke oven 1 is provided at the upper end of the supporting structure 9, underneath which supporting arm 36 two lateral rails 24 and 25 are arranged laterally at an interval from one another and between which a horizontal supporting wheel 26 of the hood structure 7 and 8 engages for taking up the tilting moment of the hood structure. Thus, according to FIG. 2 for this embodiment, the support structure comprises an upwardly directed lower rail and, upwardly spaced from said lower rail, upper rail means having a pair of adjacent, laterally spaced, vertically oriented flanges, and the frame means comprises at least one roller turnable about a substantially horizontal axis and engaging said lower rail and at least one additional roller turnable about a substantially vertical axis and being located between said flanges of said upper rail means.

A gas collecting pipe, or main, 28 extends along the top of the supporting arm 36, comprising, at intervals along its upper surface, lids 29 which are pivotally attached to the collecting pipe 28 on that side remote from the hood structure 7 and 8. Accordingly, the lid 29 can be lifted for introducing the exhaust gas from the exhaust-gas pipe 30 of the hood 7. To this end, a gas transfer gate 27 is mounted for horizontal displacement on the hood structure 7 and 8 transversely of the direction of travel thereof as indicated by the double arrow. On that side facing the lid 29, the gas transfer gate 27 comprises a roller 34 which, when the gate is displaced towards the collecting pipe 28 along the sloping guide surface 35, acts on a lug projecting from the lid 29 and, in doing so, opens the lid 29 in the direction of the arrow. In the position in which it engages below the lid 29, the gas transfer gate 27 lies with one opening over the opening of the collecting pipe 28 covered by the lid 29 and with another opening, formed in the underneath of the sloping guide surface 35, over the exhaust gas outlet 30 of the hood 7, so that the gas removed flows over into the collecting pipe 28.

As shown in FIG. 2, the hood structure 7 and 8 engages over the cake guide car 5 with side walls 33. These side walls 33 are preferably designed to be let down so that the connection between the hood structure and the cake guide car is separable.

As also shown in FIG. 2, a platform 31 for an attendant is formed on the supporting frame 8 of the hood 7. The platform 31 can be reached by steps 32 from the master walk 4 of the coke oven. In order to separate the hood structure from the cake guide car 5, the steps 32 can also be separably connected, preferably to the hood structure 7 and 8.

What we claim is:

1. In association with a coke oven having a carriageway along one side thereof and a quenching car movable along said carriageway, a combination comprising an elongated support structure extending along that side of said carriageway which is remote from the coke oven; a hood for covering the quenching car; and support frame means movable along said support structure and supporting said hood solely on said support structure.

2. A combination as defined in claim 1, wherein said elongated support structure comprises an upwardly directed lower rail and, upwardly spaced from said lower rail, upper rail means having a pair of adjacent, laterally spaced, vertically oriented flanges, and wherein said frame means comprises at least one roller turnable about a substantially horizontal axis and engaging said lower rail and at least one additional roller turnable about a substantially vertical axis and being located between said flanges of said upper rail means.

3. A combination as defined in claim 1, and including brake means on said support frame means for braking movement of said support frame means along said support structure.

4. A combination as defined in claim 1, and including means on said hood for engaging said quenching car for moving said hood and said support frame means along said support structure during movement of said quenching car along said carriageway.

5. A combination as defined in claim 1, wherein said support structure comprises a lower rail having an upwardly directed support surface and two upper rails vertically displaced from each other and both laterally displaced from said lower rail, the lateral displacement being in a direction away from the coke oven, one of said upper rails having an upwardly directed support surface and the other having a downwardly facing support surface, and wherein said support frame means comprises a plurality of rollers respectively in rolling engagement with said support surfaces of said rails.

6. A combination as defined in claim 5, wherein said support frame means comprises a counterweight projecting laterally of said upper rails in a direction away from said hood, and wherein the roller engaging said one upper rail is mounted on said counterweight.

7. A combination as defined in claim 1, wherein said elongated support structure comprises at least two rails vertically displaced from each other and said frame means comprises at least two rollers engaging said rails.

8. A combination as defined in claim 7, wherein said support frame means includes a couterweight projecting laterally of said rails in a direction away from said hood.

9. A combination as defined in claim 7, and including at least one motor mounted on said support frame means for driving at least one of said rollers.

* * * * *